US006691656B1

(12) United States Patent
Pierik et al.

(10) Patent No.: US 6,691,656 B1
(45) Date of Patent: Feb. 17, 2004

(54) CAM PHASER HYDRAULIC SEAL ASSEMBLY

(75) Inventors: Ronald J. Pierik, Rochester, NY (US); Dominic Borraccia, Spencerport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/306,039

(22) Filed: Nov. 27, 2002

(51) Int. Cl.[7] ..... F01L 1/34

(52) U.S. Cl. ..... 123/90.17; 123/90.37; 92/120

(58) Field of Search ..... 123/90.17, 90.37, 123/90.13; 92/120

(56) References Cited

U.S. PATENT DOCUMENTS 6,176,210 B1 * 1/2001 Lichti et al. ..... 123/90.17
6,230,675 B1 * 5/2001 Kobayashi et al. ..... 123/90.15
6,311,654 B1 * 11/2001 Ushida et al. ..... 123/90.17
6,314,929 B1 * 11/2001 Maeyama et al. ..... 123/90.17
6,332,438 B1 * 12/2001 Machida ..... 123/90.15

* cited by examiner

*Primary Examiner*—Thomas Denion
*Assistant Examiner*—Zelalem Eshete
(74) *Attorney, Agent, or Firm*—Patrick M. Griffin

(57) ABSTRACT

A rotary hydraulic seal assembly for sealing a rotationally eccentric annular gap between a rotating cam phaser element and a stationary cover. The assembly includes a tubular sleeve disposed between the phaser and the cover at the junctures of control oil passages in the phaser element and the cover. Passages through the sleeve allow oil flow across the sleeve at the junctures. Static seals disposed in grooves on the surface of the sleeve prevent leakage between adjacent junctures. Because the sleeve is constrained from rotating with the phaser element, the static seals are not subjected to frictional wear. The radial thickness of the sleeve is selected such that the rotational surface floats on a thin film of oil and the static seals are sealingly compressed against the stationary element. The gap filled by the film of oil is thus annular with no eccentric runout, as the sleeve is hydraulically centered; thus, cross-talk and leakage from the gap are minimized, and eccentricities between the timing-chain cover and the phaser element are radially absorbed by the static seals.

12 Claims, 5 Drawing Sheets

CAM PHASER HYDRAULIC SEAL ASSEMBLY

TECHNICAL FIELD

The present invention relates to internal combustion engines; more particularly, to engine cam phasers for controlling the phase relationship between an engine's camshaft and crankshaft; and most particularly, to a hydraulic seal assembly between fixed and rotatable elements of a cam phaser assembly.

BACKGROUND OF THE INVENTION

Cam phasers for internal combustion engines are well known. A cam phaser operates between the engine's cam timing chain or belt and a camshaft to alter the phase relationship between the camshaft and the crankshaft, thereby varying the timing relationship between the pistons' cycle and the valves' cycle on demand from an engine control module (ECM).

In a vane-type cam phaser, the phaser comprises an outer portion, known in the art as a stator, that is driven from the crankshaft by a camshaft timing chain, and an inner portion, known in the art as a rotor, that is fixedly connected to the camshaft and is rotatable through a limited central angle within the stator. The rotor and stator rotate together when the engine is running. The rotor includes outwardly-extending radial lobes which interleave with inwardly-extending radial lobes of the stator to form hydraulic timing-advance and timing-retard chambers therebetween. Controllably admitting hydraulic fluid, such as oil from the front bearing of the camshaft, to the chambers via an oil control valve (OCV) serves to change the phase angle between the rotor and stator and thus the phase angle between the crankshaft and the camshaft.

In a spline-type cam phaser, the rotor and stator are related by a piston having mating reverse-handed helical splines therebetween, the piston being hydraulically driven axially to change the relative phase of the rotor and the stator. This type of cam phaser is also actuated via an. OCV and pressurized oil supply.

Typically in the prior art, a cam phaser assembly is bolted to the end of the camshaft by a central bolt and is shrouded by a timing-chain cover bolted to the engine and thus stationary. In installations wherein only minimal engine adaptation is permitted, the OCV is mounted on the timing-chain cover. To reach the OCV, pressurized oil from the camshaft bearing passes longitudinally through the bolt, exiting through a passage in the bolt head, and then passes through a passage in the timing-chain cover and into the OCV. From the OCV, oil is selectively supplied to the cam phaser chambers via phase-advance and phase-retard passages in the timing-chain cover, in the phaser, and in the bolt.

A first problem exists in supplying oil from the stationary passages in the timing-chain cover to the rotating passages in the phaser. Even very small eccentricities in the path taken by the phaser with respect to the timing-chain cover can cause unacceptable leakage, or "cross-talk," between the advance and retard passages, or loss of pressure sufficient to affect proper actuation of the phaser. Such eccentricities can occur easily because the phaser is centered on the camshaft by a pilot surface machined on the front end of the camshaft. Thus, because of machining tolerances, the phaser is not necessarily parallel to or coincident with the camshaft axis, once installed.

Further, it can be difficult or expensive to precisely locate the timing-chain cover relative to the camshaft-mounted phaser. Mounting the cover to the engine such that the bore in the cover is precisely concentric with the phaser can require expensive machining and manufacturing controls of the camshaft, the camshaft pilot surface, the phaser, and the timing-chain cover mounting features. Sealing an eccentric gap with resilient rotary seals can be unsatisfactory because of rapid wear of the seals or on aluminum wear surfaces in the cover.

Further, the timing-chain cover, being typically formed of aluminum alloy having a relatively large thermal coefficient, may expand more rapidly than the steel phaser, affecting the clearance and therefore quality of sealing therebetween.

A second problem exists in that many prior art cam phasers require extensive engine block and/or camshaft modifications to adapt the engine for use with the cam phaser, making their use more costly and less attractive to potential customers.

What is needed is a means for providing an effective seal between the timing-chain housing and the phaser rotor which can accommodate eccentric runout therebetween without seal wear.

What is further needed is a cam phaser requiring minimal or no engine modifications for adaptation to the cam phaser.

It is a principal object of the present invention to provide an improved means for rotary sealing a cam phaser to a timing-chain cover.

It is a further object of the invention to provide such means wherein the manufacturing tolerances of the components are readily met without undue expense or difficulty.

It is a still further object of the invention to provide a cam phaser requiring minimal engine modification for use with the cam phaser.

It is a still further object of the invention to provide a cam phaser requiring no rubbing seals against an aluminum alloy surface.

SUMMARY OF THE INVENTION

Briefly described, a rotary hydraulic seal assembly for sealing a rotationally eccentric annular space between a rotating cam phaser element and a stationary housing includes a generally cylindrical tubular sleeve disposable between the phaser element and the housing at the juncture of phaser-advance and phaser-retard control oil passages in the phaser element and the housing. The phaser element is typically a phaser rotor, although it may instead be a phaser stator. Radial bores through the sleeve allow oil to flow across the sleeve at the axial location of the passage junctures. The sleeve is provided with static seals disposed in grooves on the surface outboard of each juncture to prevent leakage between the junctures. The sleeve is rotatationally pinned loosely to either the phaser element or the stationary element. Because the sleeve does not rotate relative to its pinned partner, the static seals are not subjected to frictional wear. The surface of the sleeve opposite the static seal surface floats on a thin film of oil. The gap filled by the film of oil is thus annular with no eccentric runout, as the sleeve is hydraulically centered on the phaser; thus, cross-talk and leakage from the gap are minimized, and eccentricities between the timing-chain cover and the phaser element are radially absorbed by the static seals.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
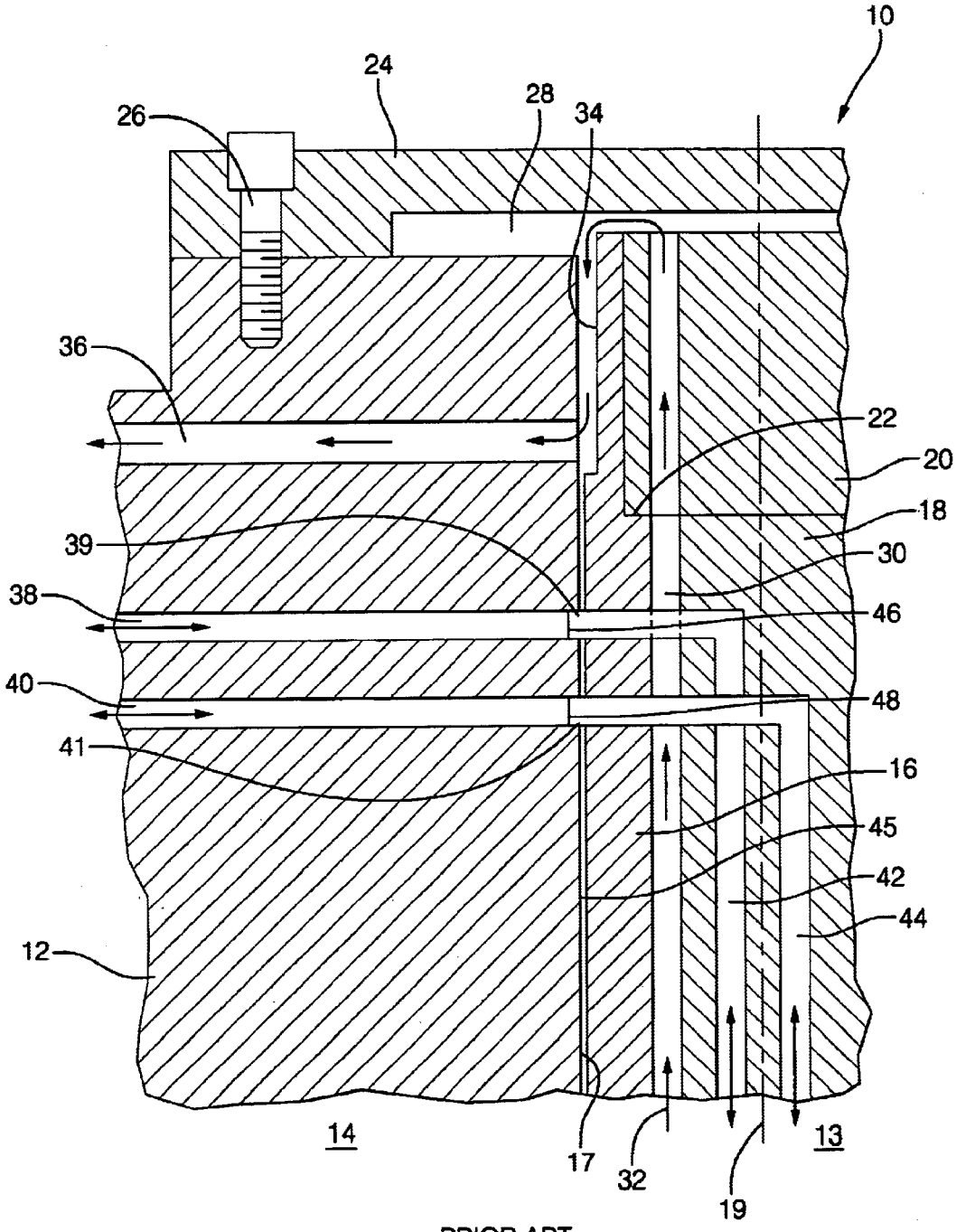
PRIOR ART FIG. 1
FIG. 1 is a cross-sectional view of a portion of a first prior art cam phaser and timing-chain cover, showing no seals therebetween.

Referring to FIG. 1, a first prior art cam phaser arrangement 10 includes a stationary timing-chain cover 12 mounted to an internal combustion engine 14, by mounting means not shown, a cylindrical cam phaser element 16 (typically but not necessarily a cam phaser rotor) disposed in a cylindrical bore 17 in cover 12 and mountable on the end of a camshaft (not shown) of engine 14 and secured thereto conventionally by bolt 18. The assembly has a rotational axis and centerline 19, the right side of the assembly being omitted for clarity of presentation. Bolt 18 includes a head 20 that engages a step 22 in element 16 to secure element 16 against the end of the camshaft. A cover plate 24 is secured to cover 12 via screw 26 to form an oil flow space 28 therebetween and between cover plate 24 and bolt head 20. Bolt 18 and head 20 include a longitudinal oil supply passage 30, comprising a channel along the surface of bolt 18 and a bore through head 20 communicating with space 28. Passage 30 further communicates with an oil supply source 32 such as an oil passage in the camshaft or a bearing thereof (not shown), such that pressurized oil is supplied via passage 30 to space 28. Element 16 is adapted, as by being necked down over a portion of its length, to provide an annular space 34 in communication between space 28 and a oil supply passage 36 formed in timing-chain cover 12. First and second control oil passages 38,40 are also provided in timing-chain cover 12. Mounted on cover 12 or in a block of engine 14 is a conventional electric solenoid switching valve (not shown) controlled conventionally by an engine control module (not shown) for supplying oil to and withdrawing oil from passages 38,40 to advance or retard the rotational position of the phaser rotor with respect to the stator (not shown) to alter the valve timing of engine 14. Passages 38,40 connect with bolt passages 42,44, respectively, at junctures 39,41 across annular gap 45 to supply oil to the advance and retard chambers of the phaser. Because phaser element 16 in operation is rotating with respect to timing-chain cover 12 and passages 38,40, each of passages 38,40 terminates in an internal annular groove 46,48, respectively, to provide oil continuously as required to passages 42,44.

Gap 45 is shown and described as being uniformly annular, but that can occur only if both bore 17 and element 12 are precisely coaxial. This is extremely difficult to achieve in practice, as the position of the timing-chain cover is governed by mounting bores and screws in the engine and the position of the phaser element is governed by bolt 18 in the camshaft; and further, all components are subject to normal manufacturing variation. Therefore, in practice, gap 45 is eccentric to some degree, which can allow oil to leak between passages 42,44 and/or out of gap 45 altogether.

Figure 2:
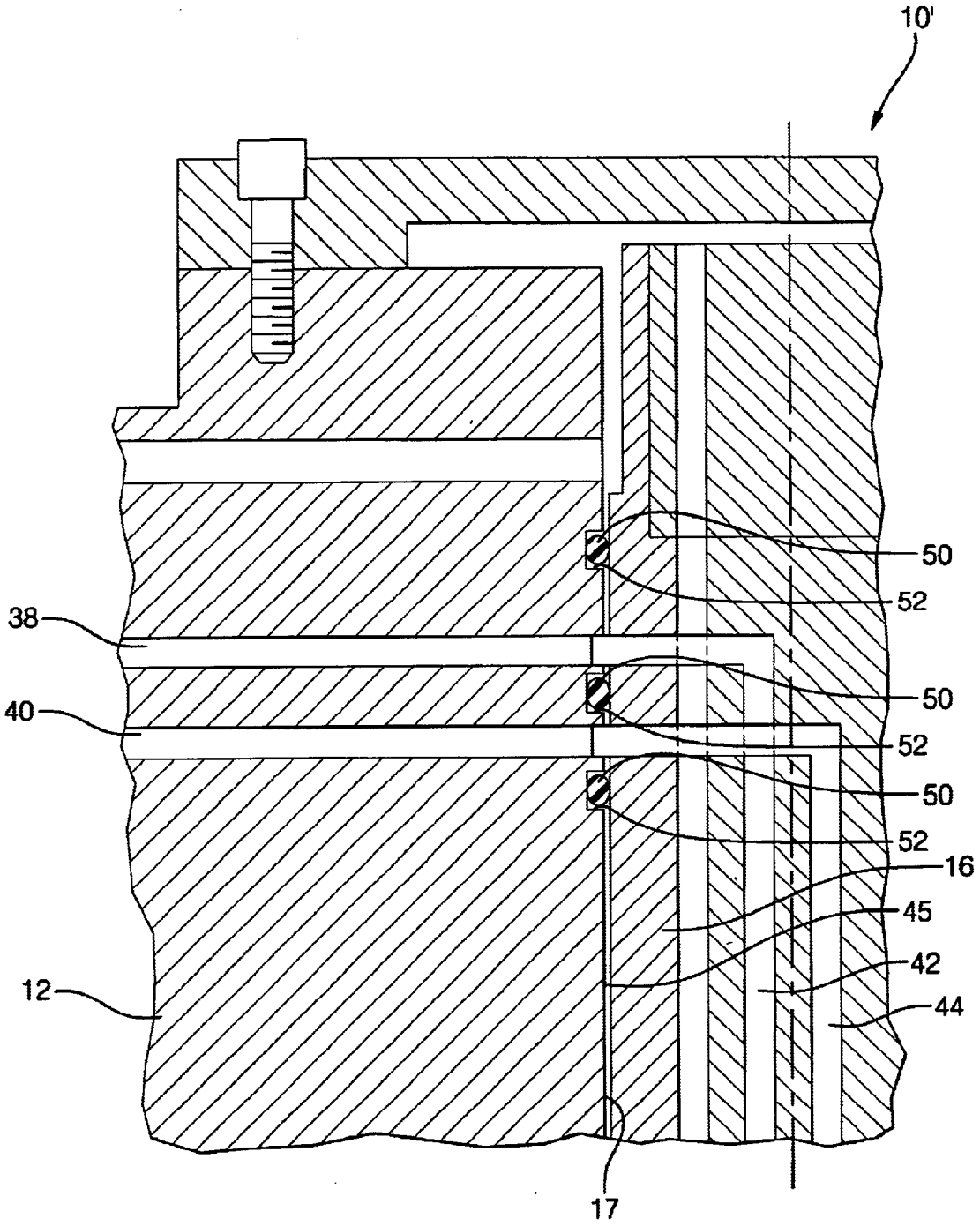
PRIOR ART FIG. 2
FIG.2 is a cross-sectional view of a portion of a second prior art cam phaser and timing-chain cover, showing rotating resilient seals therebetween.

Referring to FIG. 2, a second prior art embodiment 10' is arrangement substantially identically with embodiment 10 in FIG. 1 except that seals between cover 12 and phaser element 16 are provided in the form of O-rings 50 mounted in internal annular ring grooves 52 formed in cover 12. O-rings 50 can keep the various oil flows separate by compressing and expanding radially to absorb any rotational eccentricity in gap 45. However, contact between O-rings 50 and phaser element 16 is a sliding contact in which, even though lubricated by oil in gap 45, O-rings 50 can wear rapidly and begin to allow oil to pass by. Reversing the arrangement, placing the O-rings on element 16 and allowing them to slide along bore 17, is even worse because cover 12, being formed typically from aluminum alloy, may also wear rapidly.

What is needed is a mechanism whereby the beneficial property of radially resilient elements such as O-rings 50 is employed but in a non-sliding structure.

Figure 3:
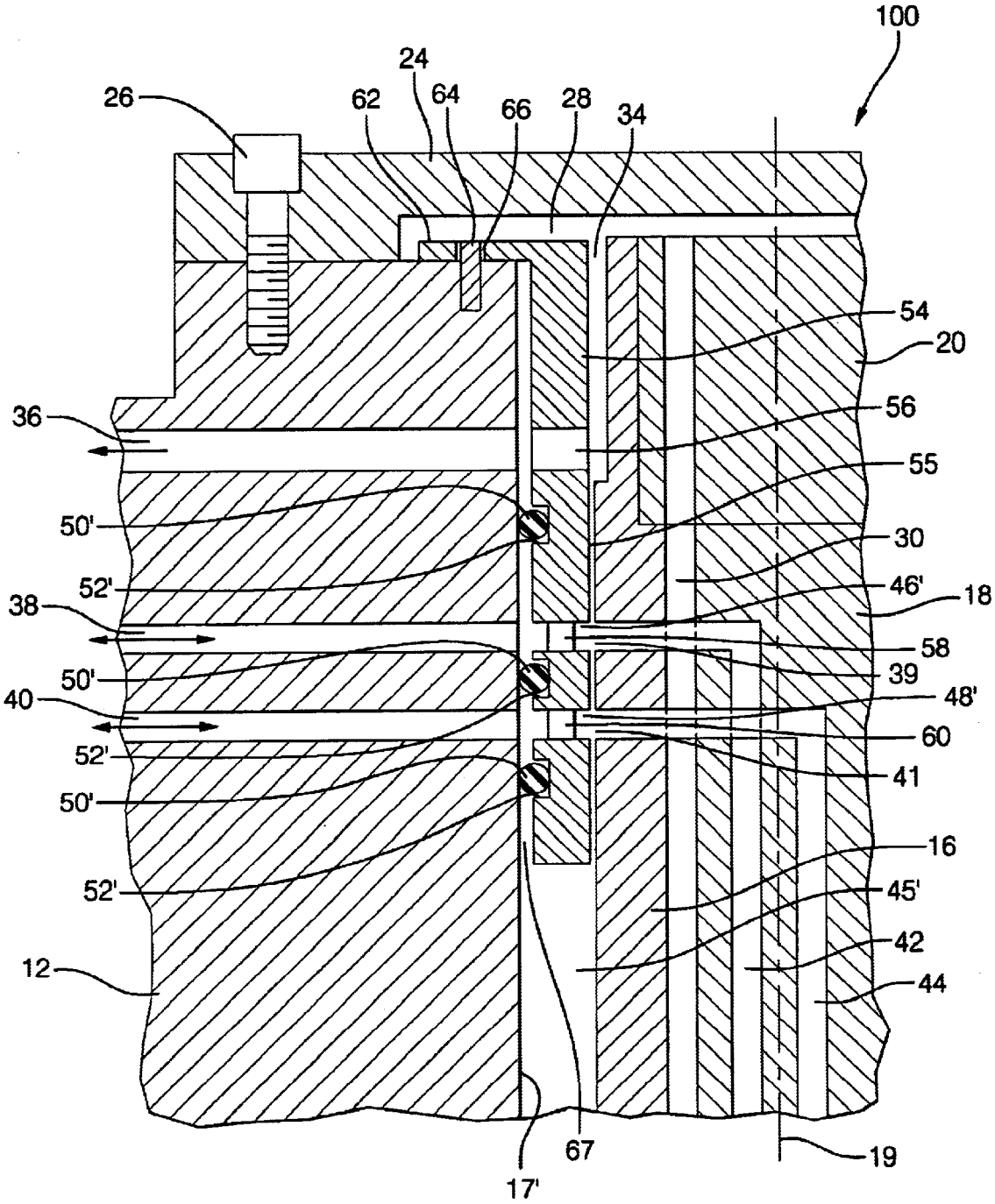
FIG. 3 is a cross-sectional view of a first embodiment of a cam phaser rotary hydraulic seal assembly in accordance with the invention.

Referring to FIG. 3, a first embodiment 100 of a cam phaser hydraulic seal assembly in accordance with the invention is arranged similarly to prior art embodiments 10,10' regarding layout of timing-chain cover 12, cover plate 24, phaser element 16, bolt 18 and head 20, and oil passages 28,30,34,36,38,40,42,44. However, bore 17' in timing-chain cover 12 is substantially greater in diameter than bore 17, creating an annular gap 45' having a greater radial dimension than gap 45. A cylindrical sleeve 54 having a radial dimension less than the radial dimension of gap 45' is disposed in gap 45'. A first radial bore 56 through sleeve 54 is positioned to allow supply oil to pass from chamber 34 to passage 36. Second and third radial bores 58,60 through sleeve 54 allow passages 38,40 to communicate with passages 42,44 at junctures 39,41. Because element 16 rotates with respect to sleeve 54, the sleeve has annular grooves 46',48', analogous to grooves 46,48, formed in its radially inner surface to function as annular reservoirs during rotation of the phaser past the sleeve. A radial flange 62 on sleeve 54 is loosely pinned to timing-chain cover 12 via pin 64 and hole 66 in flange 62, the diameter of the hole being greater than the diameter of the pin, permitting sleeve 54 to be hydraulically centered by oil on phaser element 16. Axial cross-talk between, and leakage from, passages 38,40 is prevented by static seals such as, for example, O-rings, packings, or lip seals 50' mounted in annular grooves 52' formed in the outer surface of sleeve 54. Thus the sleeve, without rotating, follows the apparent rotational path of phaser element 16, providing a small, uniform, annular gap 55 therebetween, while the static seals disposed in annular gap 67 provide a stationary, resilient, non-wearing seal against the timing-chain cover.

Figure 4:
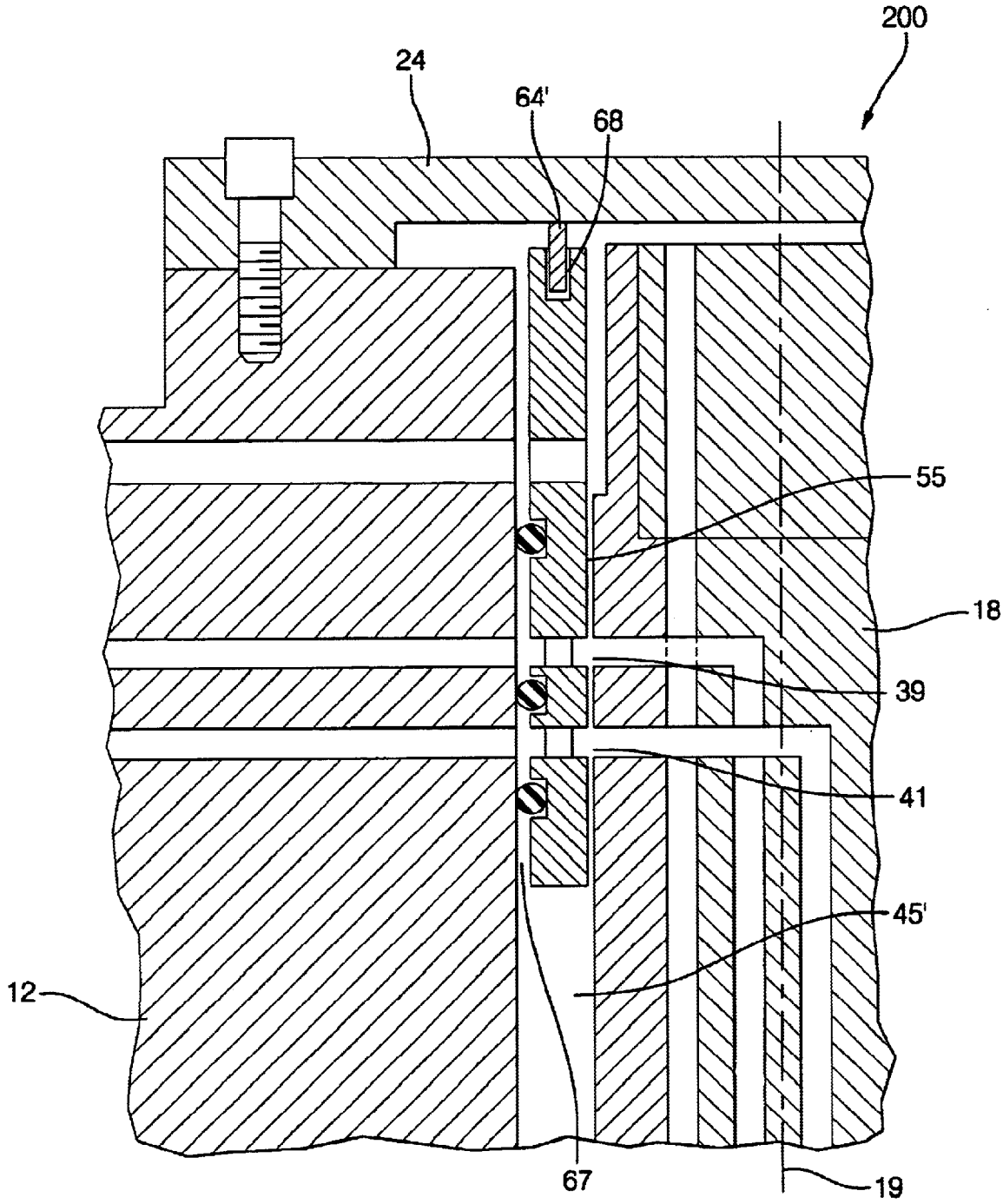
FIG. 4 is a cross-sectional view of a second embodiment of a cam phaser rotary hydraulic seal assembly in accordance with the invention.

Referring to FIG. 4, a second embodiment 200 of a cam phaser hydraulic seal assembly in accordance with the invention is arranged similarly to embodiment 100 except that flange 62 is omitted and pin 64' extends from cover 24 and engages an oversize well 68 in sleeve 54', again to prevent the sleeve from rotating with the phaser element while permitting the sleeve to float radially in response to imposed eccentricities. Embodiment 200 may be preferred over embodiment 100 for reduced cost of manufacture (no flange required).

Figure 5:
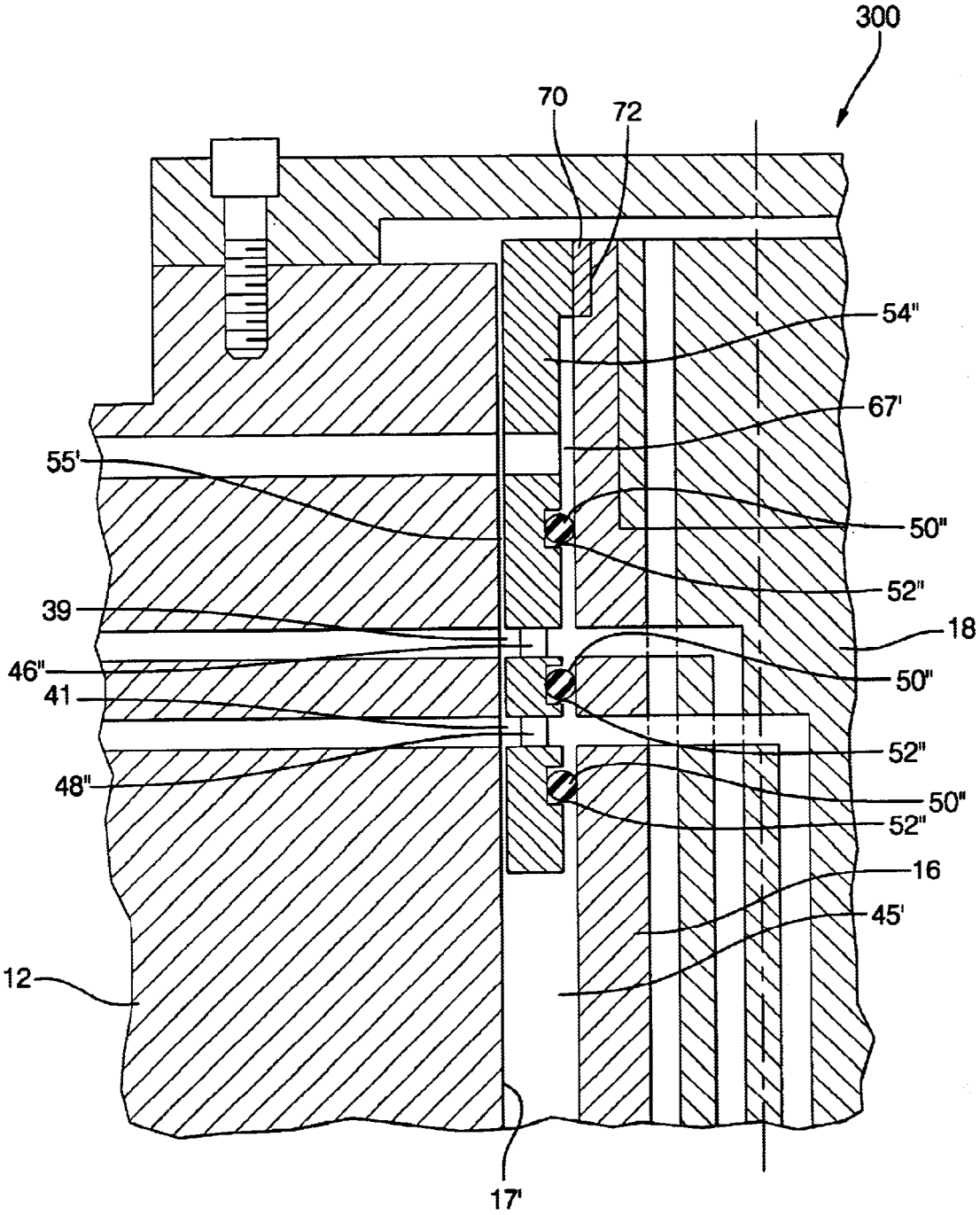
FIG. 5 is a cross-sectional view of a third embodiment of a cam phaser rotary hydraulic seal assembly in accordance with the invention.

Referring to FIG. 5, a third embodiment 300 of a cam phaser hydraulic seal assembly in accordance with the invention is arranged similarly to embodiments 100,200 except that sleeve 54" is adapted to rotate with phaser element 16 while being centered on timing-chain cover bore 17. Sleeve 54" is provided with a rib 70 formed on the inner surface thereof for engaging a slot 72 formed in phaser element 16 to cause sleeve 54" to rotate therewith. Static seals such as, for example, O-rings, packings, or lip seals 50" are disposed in grooves 52" in the inner surface of sleeve 54" for sealing against phaser element 16 to prevent cross-talk, the phaser element and sleeve having no relative rotation therebetween. Annular grooves 46", 48" are formed in the outer surface of sleeve 54" to function as annular reservoirs during rotation of the sleeve past the timing-chain cover. Thus the sleeve, while rotating with the phaser, follows the apparent rotational path of bore 17, providing a small, uniform, annular gap 55' therebetween, while the static seals disposed in annular gap 67' provide a stationary, resilient, non-wearing seal against the phaser.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A hydraulic seal assembly for a cam phaser disposable on a camshaft of an internal combustion engine, the seal assembly being for sealing a rotatable phaser element to a stationary element, comprising:

a) a cylindrical sleeve disposable between said phaser element and said stationary element to form a first generally annular space between said sleeve and said phaser element and a second generally annular space between said sleeve and said stationary element;

b) means for preventing rotation of said sleeve with said phaser element;

c) radially-resilient seal means disposed in said second annular space; and d) means for admitting hydraulic fluid to said first annular space to form a uniform hydraulic film between said sleeve and said phaser element.

2. A seal assembly in accordance with claim 1 wherein said phaser element is a phaser rotor.

3. A seal assembly in accordance with claim 1 wherein said phaser element is a phaser stator.

4. A seal assembly in accordance with claim 1 wherein said phaser is a vane-type phaser.

5. A seal assembly in accordance with claim 1 wherein said phaser is a spline-type phaser.

6. A seal assembly in accordance with claim 1 wherein said stationary element is a timing-chain cover.

7. A seal assembly in accordance with claim 1 wherein said phaser element and said stationary element include passages, and wherein said seal assembly includes at least one radial bore for permitting flow of oil between said phaser element passages and said stationary element passages.

8. A seal assembly in accordance with claim 1 wherein said radially-resilient seal means includes at least one static seal.

9. A seal assembly in accordance with claim 1 wherein said hydraulic fluid is engine oil.

10. A seal assembly in accordance with claim 1 wherein said means for rotationally immobilizing includes a pin disposed on said stationary element and an opening in said sleeve.

11. A hydraulic seal assembly for a cam phaser disposable on a camshaft of an internal combustion engine, the seal assembly being for sealing a rotatable phaser element to a stationary element, comprising:

a) a cylindrical sleeve disposable between said phaser element and said stationary element to form a first generally annular space between said sleeve and said phaser element and a second generally annular space between said sleeve and said stationary element;

b) means for causing said sleeve to rotate with said phaser element;

c) radially-resilient seal means disposed in said first annular space; and d) means for admitting hydraulic fluid to said second annular space to form a uniform hydraulic film between said sleeve and said stationary element.

12. An internal combustion engine comprising a hydraulic seal assembly for a cam phaser disposed on a camshaft of said engine, said seal assembly being for sealing a rotatable phaser element to a stationary element and including a cylindrical sleeve disposed between said phaser element and said stationary element to form a first generally annular space between said sleeve and said phaser element and a second generally annular space between said sleeve and said stationary element, means for preventing rotation of said sleeve with said phaser element, radially-resilient seal means disposed in said second annular space, and means for admitting hydraulic fluid to said first annular space to form a uniform hydraulic film between said sleeve and said phaser element.

* * * * *